US006988328B2

(12) United States Patent
Rosen et al.

(10) Patent No.: US 6,988,328 B2
(45) Date of Patent: Jan. 24, 2006

(54) SHOE COVER

(76) Inventors: Glenn M. Rosen, 200 Winston Dr., Apt. 2505, Cliffside Park, NJ (US) 07010; Neil Cohen, 9 E. 19th St., 8th Floor, New York, NY (US) 10003

( * ) Notice: Subject to any disclaimer, the term of this patent is extended or adjusted under 35 U.S.C. 154(b) by 101 days.

(21) Appl. No.: 10/671,184

(22) Filed: Sep. 25, 2003

(65) Prior Publication Data

US 2005/0066543 A1 Mar. 31, 2005

(51) Int. Cl.
*A43B 3/16* (2006.01)
*A43B 3/10* (2006.01)
*A43B 3/12* (2006.01)

(52) U.S. Cl. ..... 36/7.1 R; 36/7.3; 36/7.5; 36/59 R; 36/73

(58) Field of Classification Search ..... 36/7.1 R, 36/97, 7.3, 7.5, 7.6, 112, 15, 59 R, 62, 73
See application file for complete search history.

(56) References Cited

U.S. PATENT DOCUMENTS

| | | | | |
|---|---|---|---|---|
| 1,154,890 | A | | 9/1915 | Sauer, Jr. |
| 1,704,688 | A | | 3/1929 | Valentine et al. |
| 2,024,766 | A | | 12/1935 | Ingwer |
| 2,102,265 | A | | 12/1937 | Halberstadt |
| 2,132,523 | A | | 10/1938 | Berry |
| 2,188,603 | A | | 1/1940 | Hamalainen |
| 2,666,996 | A | | 1/1954 | Odland |
| 3,146,535 | A | | 9/1964 | Owings |
| 3,283,423 | A | | 11/1966 | Schovee |
| 3,718,993 | A | | 3/1973 | Schovee |
| 4,299,037 | A | | 11/1981 | Carey |
| 4,351,120 | A | * | 9/1982 | Dalebout ..... 36/15 |
| 4,392,311 | A | | 7/1983 | Rudolf et al. |
| 4,489,509 | A | | 12/1984 | Libit |
| 5,056,240 | A | | 10/1991 | Sherrill |
| 5,282,327 | A | | 2/1994 | Ogle |
| 5,481,814 | A | | 1/1996 | Spencer |
| D377,710 | S | | 2/1997 | Poust |
| 5,638,614 | A | | 6/1997 | Hardy |
| 5,666,746 | A | | 9/1997 | Pollard |
| D394,740 | S | | 6/1998 | Poust |
| 5,813,149 | A | | 9/1998 | Baker et al. |
| 5,842,290 | A | | 12/1998 | Mills |
| 6,044,578 | A | * | 4/2000 | Kelz ..... 36/7.5 |
| 6,438,872 | B1 | | 8/2002 | Chil et al. |
| 2002/0166257 | A1 | | 11/2002 | Wilkinson |

FOREIGN PATENT DOCUMENTS

| | | | |
|---|---|---|---|
| EP | 0326304 | * | 8/1989 |

* cited by examiner

*Primary Examiner*—Anthony Stashick
(74) *Attorney, Agent, or Firm*—Notaro & Michalos P.C.

(57) ABSTRACT

A shoe cover has an upper and a sole connected to the upper. The upper includes at least one, self-supporting and resilient shoe admission portion connected to the sole. The shoe admission portion has an inwardly inclined lead-in surface extending toward the sole, and an overhang surface extending from the lead-in surface toward the sole portion. The overhang surface is adapted to form an undercut area so that a shoe to be held to the shoe cover first engages and slides along the inclined lead-in surface to resiliently expand the admission portion outwardly without being crushed, and then slides into engagement with the overhang surface to enter the undercut area. A length adjusting mechanism may be provided for adjusting the length of the sole.

29 Claims, 12 Drawing Sheets

SHOE COVER

FIELD AND BACKGROUND OF THE INVENTION

The present invention relates generally to the field of foot-wear, and in particular to a new and useful shoe cover that is easily donned and removed, preferably without the hands, so as to cover the shoes instead of having to remove them when entering areas where the shoes should be removed, such as a person's home who wished visitors to remove their shoes before entering.

A very high percentage of the Asian population throughout the world removes their shoes when entering their own home or another's home as a guest. The reasons are almost solely related to general cleanliness and health. They either walk around the home in socks or put on slippers kept by the entry door.

People in non-Asian countries such as the US are quickly adopting this practice of removing one's shoes upon entering a home. Some non-Asian countries already have a large majority of people adhering to this practice. More and more people throughout the world believe that bringing in dirt from the outside is not only unattractive, but that the germs, bacteria, chemicals, etc. carried on shoe soles can be very unhealthy.

While removing one's shoes is a perfectly acceptable solution if one intends to remain at home for some extended period, it is not acceptable and an issue in the following cases:

1. workmen entering the home;
2. children running in for a short time while playing outside;
3. guests not staying long or who prefer not to remove their shoes;
4. the need to quickly return and get something after putting on one's shoes when just leaving the home; and
5. making multiple trips carrying packages in or out of the home.

There is evidence that this is indeed a real problem being hotly debated. Internet websites that provide message boards for individuals to vent any issues are common. A number of discussion threads were devoted to discussing the reasons for, and problems of, taking one's shoes off upon entering a home. A much larger than average number of people participated in these discussions. One thread was found with hundreds of people exchanging their views on a daily basis in 2003.

To sum up the many responses, many people felt very strongly that for both cleanliness and health reasons one's shoes should always be removed upon entering a home. The minority of responses were from people that enjoyed taunting the "particular nature" of the majority with this view. In almost all the responses, people seemed resigned to the fate of having to choose between just two states of the world: shoes on or off. In only a couple of responses did people suggest putting down cardboard for workmen or the use of hospital booties to solve the problem.

A few small companies have arisen, attempting to market a version of the hospital bootie to workmen. Some large companies that sell cleaning and other supplies to different type of workmen, include a version of the hospital bootie in their catalog. Workmen are encouraged to bring the bootie with them when visiting customers' homes to show respect. Few people have ever witnessed a workman that has done this, however. Such a product is difficult and/or inconvenient to use since it requires the hands to don and remove, often does not stay securely on the shoe, and once removed may be left upside-down or inside-out so that any dirt from the shoes may still be left on the floor.

Without the use of any such product:

parents are often heard yelling at their kids to remember to take off their shoes;

homeowners with enough courage ask that workmen and/or guests remove their shoes; and/or people reluctantly violate their own rules at the thought of removing their shoes for just a few minutes.

The need to protect floors is not limited to home use. In businesses where clean and not-so-clean areas meet up (e.g. auto dealerships, manufacturing plants, animal care facilities and the like), a shoe cover can be very useful. In these cases, a shoe cover could even be used to protect the shoes from being dirtied when entering a not-so-clean area.

An ideal solution to this problem that has not yet been created is to provide a two (children/adult) or three (small/medium/large) size fits-all product that easily attaches and fits securely under a shoe so that the cleanliness and health concerns are addressed without having to remove the shoes.

The most important concept to the product solution is a design that allows the product to be easily attached and removed "hands-free" without bending down. Ideally, only a small part of the product would actually cover the upper portion of the shoe.

The following list of U.S. Pat. Nos. was found to be relevant to the present invention: 1,154,890 to Sauer; 1,704,688 to Valentine et al.; 2,024,766 to Ingwer; 2,102,265 to Halberstadt; 2,132,523 to Berry; 2,188,603 to Hamalainen; 2,666,996 to Odland; 3,146,535 to Owings; 3,283,423 to Schovee; 3,718,993 to Schovee; 4,299,037 to Carey; 4,392,311 to Rudolf et al.; 4,489,509 to Libit; 5,056,240 to Sherrill; 5,282,327 to Ogle; 5,481,814 to Spencer; 5,638,614 Hardy; 5,666,746 to Pollard; 5,813,149 to Baker et al.; 5,842,290 to Mills; 6,438,872 to Chil et al.; Des. 377,710 to Poust, Des. 394,740 to Poust; and Published U.S. patent application Ser. No. 2002/0,166,257 to Wilkinson.

U.S. Pat. No. 4,299,037 to Carey discloses a boot device for attachment to the sole of a boot, which includes a toe portion, a heel portion and a thin resilient middle portion stretchably connecting the toe and heel portions.

U.S. Pat. No. 5,282,327 to Ogle discloses a pivotal heel for footwear which allows a wearer to put the footwear on without the use of hands. The heel is spring biased into a retracted or inclined position. When a wearer inserts his foot into the footwear, the heel is forced into a normal or upright position that is latched. A release mechanism, operated by a push rod, projecting from the rear of the shoe, releases the latch maintaining the heel in the upright position so that the heel becomes inclined again. The push rod may be depressed by the user's other foot.

U.S. Pat. No. 5,666,746 to Pollard discloses an adjustable length spiked shoe protector comprising a front sole portion and a heel portion joined by an adjustment strap. The strap is affixed to the front side portion. The strap can be threaded through recess in the heel portion. The front portion of the recess has tabs. The tabs can be inserted into apertures of the strap which are located at various lengths along the strap. The front sole portion can therefore be drawn closer to or further away from the heel portion based on the length of the strap when it is attached to the tabs of the front recess portion of the heel. The sole protector can therefore be adjusted in length to accommodate different shoe sizes.

U.S. Pat. No. 1,154,890 to Sauer discloses a device that can be removably attached to the sole of the wearer's shoe. The device comprises a front portion clamped to the front shoe sole, a rear portion clamped to the heel, and an adjustable interconnecting portion held between the front and rear portions via springs secured to chains. The interconnecting portion comprises a tongue at one end which overlaps a bridge that starts at the other end. The tongue has a series of apertures. A buckle may be passed through one of the apertures of the tongue to adjust the distance between the front and rear clamps.

U.S. Pat. No. 5,813,149 to Baker et al. discloses an overshoe type of boot with rear expansion flaps to allow easy ingress and egress. The boot is sized to the fitted over a specific sized foot. The components of the boot are molded integral with one another. The expansion flap has opposed flap side walls connected to the boot leg side walls, and a rear wall connected to the side walls. At its upper end, the rear wall is spaced rearwardly from the boot leg's rear edge. When the boot is worn, the expansion flap can be wrapped against one of the side walls of the boot leg and fastened thereto.

U.S. Pat. No. 1,704,688 to Valentine et al. discloses an overshoe which contains elastic springs extending horizontally at spaced intervals across expandable portions or gussets of the overshoe. The opening to the overshoe can be expanded via the expansion of the springs to provide easy ingress. When the springs are contracted, the foot is secured within the overshoe. In order to take off the overshoe, it is only necessary to press down on the heel with the other foot, causing the springs to expand, thereby expanding the opening to the overshoe.

Published application Ser. No. 2002/0,166,257 to Wilkinson discloses a slip-on shoe for warm weather incorporating the desirable features of a sneaker and a sandal. In some embodiments it may have a backwardly angled heel section and/or a strap to wrap around the foot for a more secure fit.

SUMMARY OF THE INVENTION

The invention provides a shoe cover that covers the shoe sole and part of the shoe upper.

One purpose is to protect floors from being dirtied, scuffed, scratched or wetted by a shoe. Another purpose is to protect a shoe sole from becoming dirtied by walking in an unclean area.

A basic embodiment is a fixed length device and accommodates at least one-half inch in shoe length variation (about 4 shoe sizes for e.g.: 8, 8½, 9, 9½).

An enhanced embodiment includes a length adjustment mechanism in the sole of the shoe cover. For example, a version can be made that accommodates an additional two inches in shoe variation. With this length adjustability, just three shoe cover sizes (small/medium/large) are needed to accommodate all users: men (sizes 6 to 14), women (sizes 4 to 12) and children (sizes 8 to 13).

Both versions are designed as a stable shaped, self supporting shoe cover put on with a simple, single action of stepping into it. There is no need to stretch into it or hold it down in any way.

An advantage is that entry is accomplished without the use of hands or the other foot.

The shoe cover of the invention is also designed to securely accommodate a wide range of shoe sizes and styles without any adjustment.

The inventive shoe cover also has a size that can be adjusted hands-free to accommodate an even greater range of shoe sizes and the adjustment mechanism itself is unique.

It is important that the invention be a self-supporting shoe cover designed for simple single action step-in without the use of hands or the other foot and further designed to allow a shoe cover of a given size to accommodate shoes of varying lengths, widths and shapes. The light weight and secure fit of the invention allows the covers to stay on during rigorous walking.

The shoe cover's upper should be comprised of one or more admission areas designed to guide and hold the shoe in the shoe cover. The top portion of the admission area is the lead-in surface. The lead-in surface may have an arcuate or straight shape directed inwardly toward the sole. The lead-in surface of the upper can be located at the toe, heel, sides or any combination of these locations. At the start of the step-in process, the force applied by the shoe on the lead-in surface (designed to guide and slide, and not grip) of the upper causes the upper to spread away if necessary, making room for the shoe. The lead-in surface should be slippery enough and rigid enough so that the shoe will be guided into the shoe cover and not get stuck and/or crush the upper without entering the shoe cover.

The lead-in surface, may include a rotating or sliding part that makes it easier for the shoe to enter the cover in a more frictionless manner. Shoe entry may cause the lead-in surface to straighten up, thus narrowing the shoe cover upper, and allowing greater ease of use.

Below the lead-in surface is a pinch point through which the shoe travels on its way to reaching the sole. The pinch point is usually narrower than the lowest area of the upper and provides increased points and forces of contact with the shoe as well as helping to maintain secure contact between the shoe sole and the sole of the shoe cover. While the pinch point is not a mandatory feature, it improves the fit.

The upper is resilient and is always attempting to return to the same position and shape it is in when it is empty—with no shoe inserted. Material lining the upper at the pinch point and below can intuitively and passively conform to the shape of the shoe, by compressing and expanding, creating an infinite number of contact points and exerting forces to provide a more secure fit. It can also have ridges or corrugations that point down or in, further improving the fit.

From front to back, the upper of the shoe cover is logically divided into a toe, an intermediate and a heel portion. Secure fit is provided by sufficient contact with at least one of the portions of the upper. The front portion of the sole may be flexible to be able to bend as shoes do.

It is therefore an object of the present invention to provide a shoe cover which can comprise a toe portion, a heel portion and an intermediate portion with a mechanism for length adjustment in the intermediate portion in some embodiments of the invention. When present, the length adjusting mechanism includes an actuator at the rear end of the heel portion, which, when activated, changes the length of the shoe cover.

A sole portion of the shoe cover extends from the toe portion, across the intermediate portion and to the heel portion to unify the structure into a single functional whole, for covering a user's shoe in an effective, simple, consentient and hands-free manner.

At least one of the three upper portions (the toe, the intermediate and/or the heel portions) can have walls made at least partly of self-supporting and resilient material, e.g. foam rubber or neoprene, with reinforcing if needed so that the walls stay upright when the shoe cover is not being worn, and are sufficiently rigid to withstand the donning or shoe insertion process, but also resilient so that at least part of the wall can expand to admit the shoe. The walls may gradually thicken toward the center and then sharply become thinner near the sole portion, or have another shape for easily admitting the shoe from above, but also forming an indentation or undercut in the wall near the sole portion for thereafter retaining the shoe to the shoe cover. As a result, the thickest area of the wall or special shape of the wall often overhangs the indentation or recess.

The length adjusting mechanism, which is provided in the sole portion, closes to shorten the shoe cover when the heel portion is pushed toward the toe portion, or at least when the two portions are pushed toward each other. This shortened position is maintained by an automatic locking of the mechanism in position, until the actuator is pushed, e.g. down by the toe of the other foot, to release the lock. Biasing means in the mechanism then cause it to expand so that the toe and heel portions move apart to lengthen the shoe cover. The biasing means may alternatively be designed so that the shoe cover may be pulled apart and shortened when the actuator is pushed.

On one embodiment of the invention the mechanism includes a flexible toe plate with a recess and a series of spaced notches along the facing edges of the recess, a heel plate slidably engaged to the toe plate, a spring between the toe and heel plates for biasing them apart, a locking member mounted to the heel plate and moveable in the recess and an expansion button forming the actuator that is pushed down into engagement with the locking member to unlock it. The locking member comprises a pair of legs that are pivotally connected to each other, each with a projecting tooth that engaged the notched on one edge of the recess. The teeth and notches are shaped so that when the heel portion is pushed toward the toe portion, the locking member clicks ever deeper into the recess. In each position, the teeth lock in place, however so that the heel portion cannot move away from the toe portion. During this closing or shortening of the mechanism, the spring is compressed. This inward motion is continued until the shoe is firmly captured in the shoe cover.

To increase the shoe cover length, the button is pushed down into the locking member to cause the legs to pivot toward each other. This releases the teeth from the notches and the biasing action of the compressed spring caused the toe and heel portions to move apart.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
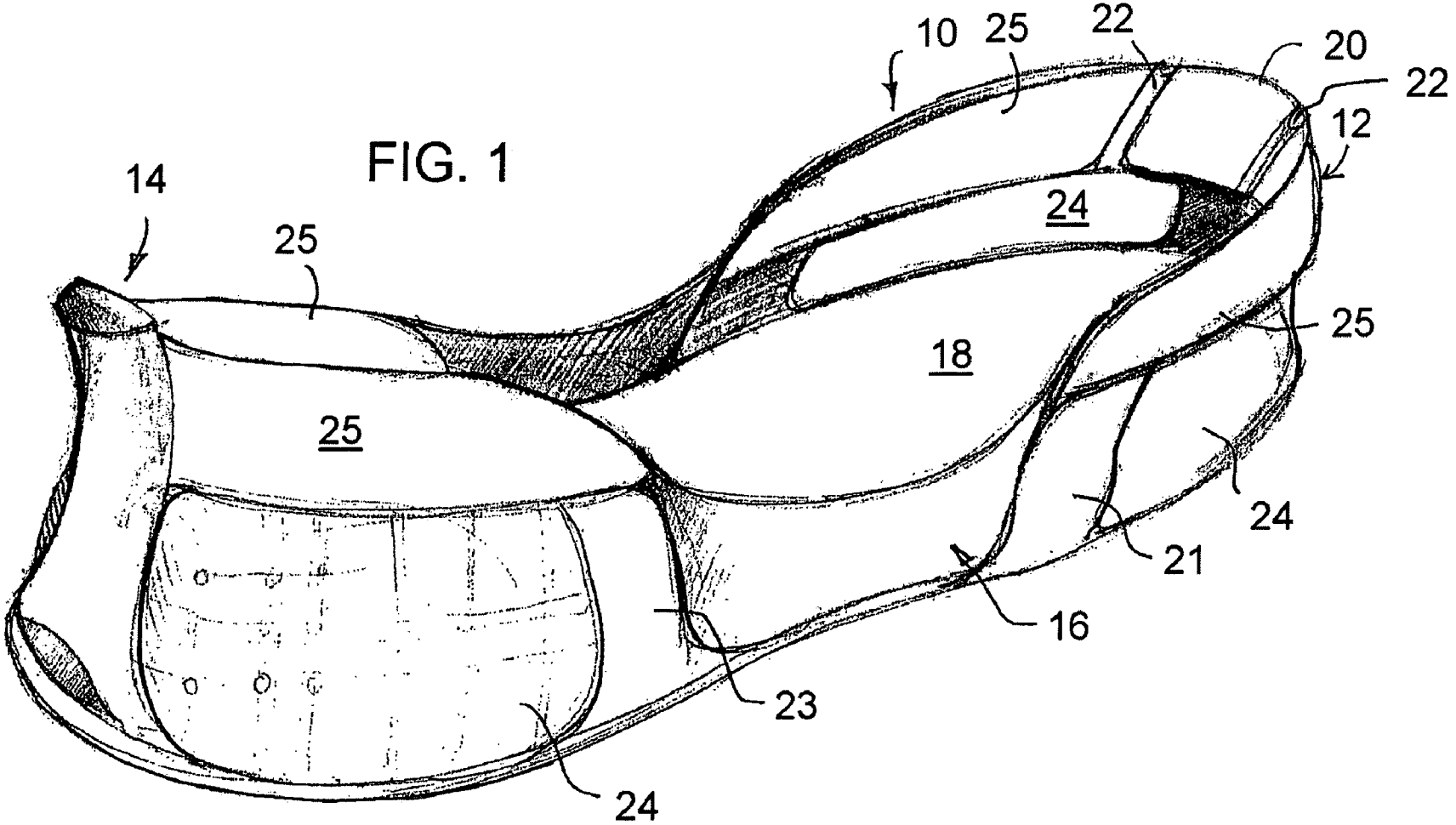
FIG. 1 is a perspective view of one embodiment of a shoe cover according to the invention.

Referring now to the drawings, in which like reference numerals are used to refer to the same or similar elements, FIGS. 1 to 5 illustrate a shoe cover generally designated 10, which is easy to don (i.e. put on) without using the hands. It comprises an upper or upper portion having toe portion 12 for receiving the toe of a shoe and a heel portion 14 for receiving the heel of a shoe. In the embodiment of FIG. 1, the upper also includes an intermediate portion 16 connected between the toe and heel portions. A sole portion 18, forming the floor of the shoe cover, is connected to the toe, the heel and the intermediate portions.

The sole portion 18 is flexible to allow walking when a shoe is held in the shoe cover, as are the other portions of the cover.

A self-supporting and resilient wall at perimeters of the toe, heel and intermediate portions, extends upwardly from the sole portion 18 for extending around a shoe held in the shoe cover to retain the shoe to the shoe cover and to at least party cover the shoe so that dirt and microbes from the shoe are generally retained with the shoe, and/or dirt and microbes from the outside are kept away from the shoe.

The wall includes at least one resilient shoe admission portion or finger 20, connected to toe portion 12. Such a shoe admission portion may alternatively or additionally be provided in the wall of the heel portion or intermediate portion, or more than one, e.g. three to five such fingers, may be provided in either or both of the heel and toe portions and in the intermediate portion. The embodiment for FIG. 1 has three such fingers in each of the heel and toe portions of the shoe cover.

Figure 4:
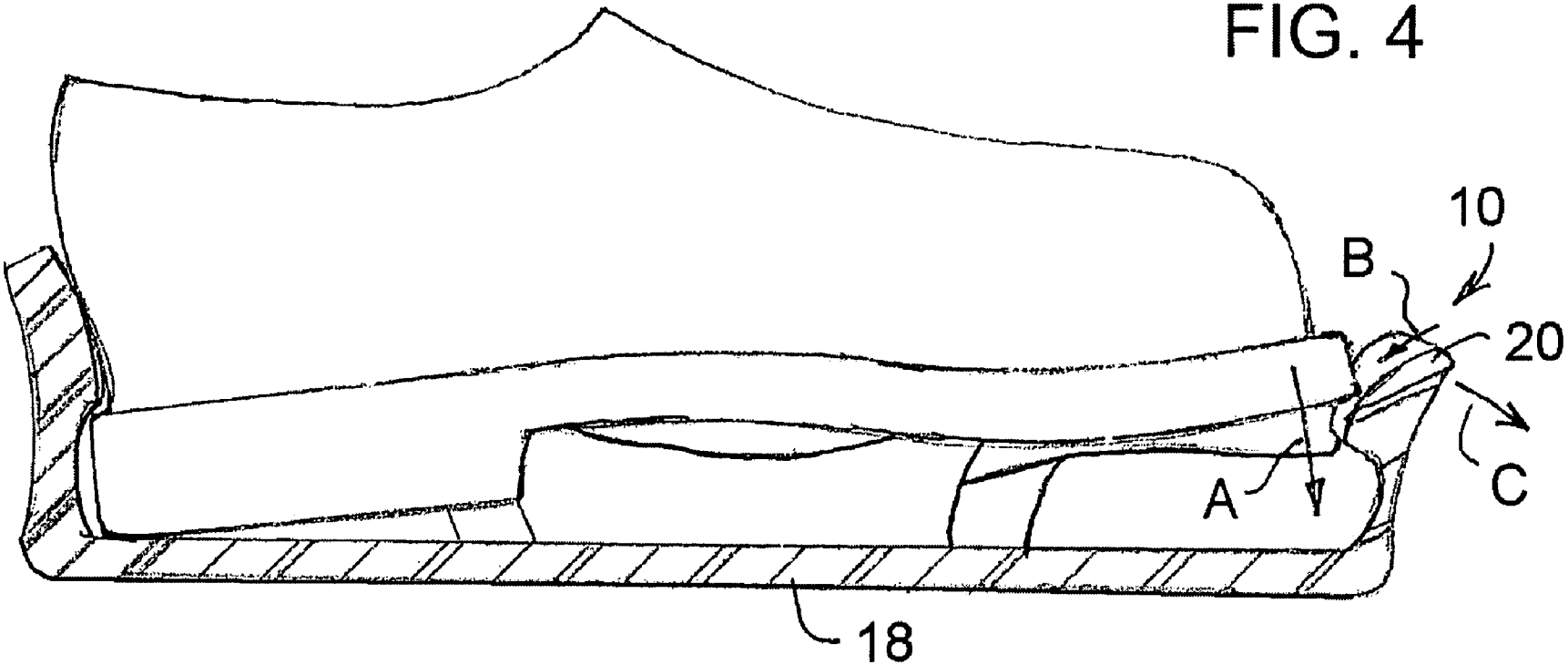
FIG. 4 is a view similar to FIG. 3 of a heel-first method of donning the shoe cover of the invention.
Figure 5:
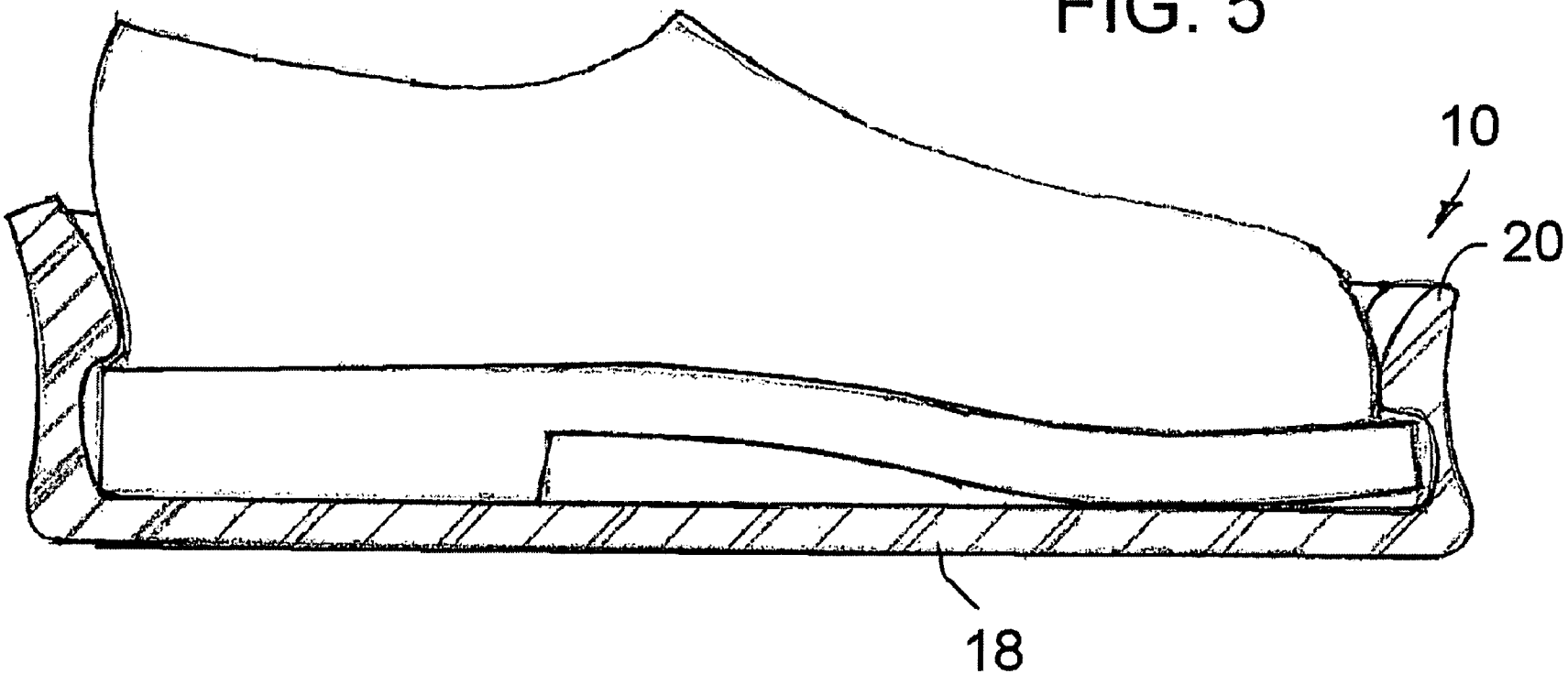
FIG. 5 is a view similar to FIGS. 3 and 4, but with the shoe fully engaged with the shoe cover of the invention.

Each of the admission portions or fingers has an inwardly inclined lead-in surface 20*a* extending toward the sole portion 18, and an initially outwardly extending overhang surface 20*b* that curves around and extends to the sole portion to form an undercut area or recess 20*c*. A shoe, in particular the sole of a shoe, is retained in this undercut area after it first engages and slides along the inclined lead-in surface 20*a* to resiliently expand the admission portion outwardly of the sole portion as shown in FIG. 4, without crushing the wall, and then slides into engagement with the overhang surface to enter the undercut area when the shoe touches the sole portion as shown in FIG. 5, while the shoe admission portion resiliently contracts to hold the shoe. This is after the shoe has been inserted, heel-first, into the shoe cover of FIG. 4. The inclined surface is curved, but generally extends at an acute angle of about 10° to 80° to the plane of the sole portion 18, or preferably 20° to 70° to the plane, or even more preferably, 30° to 60° to the plane.

Figure 3:
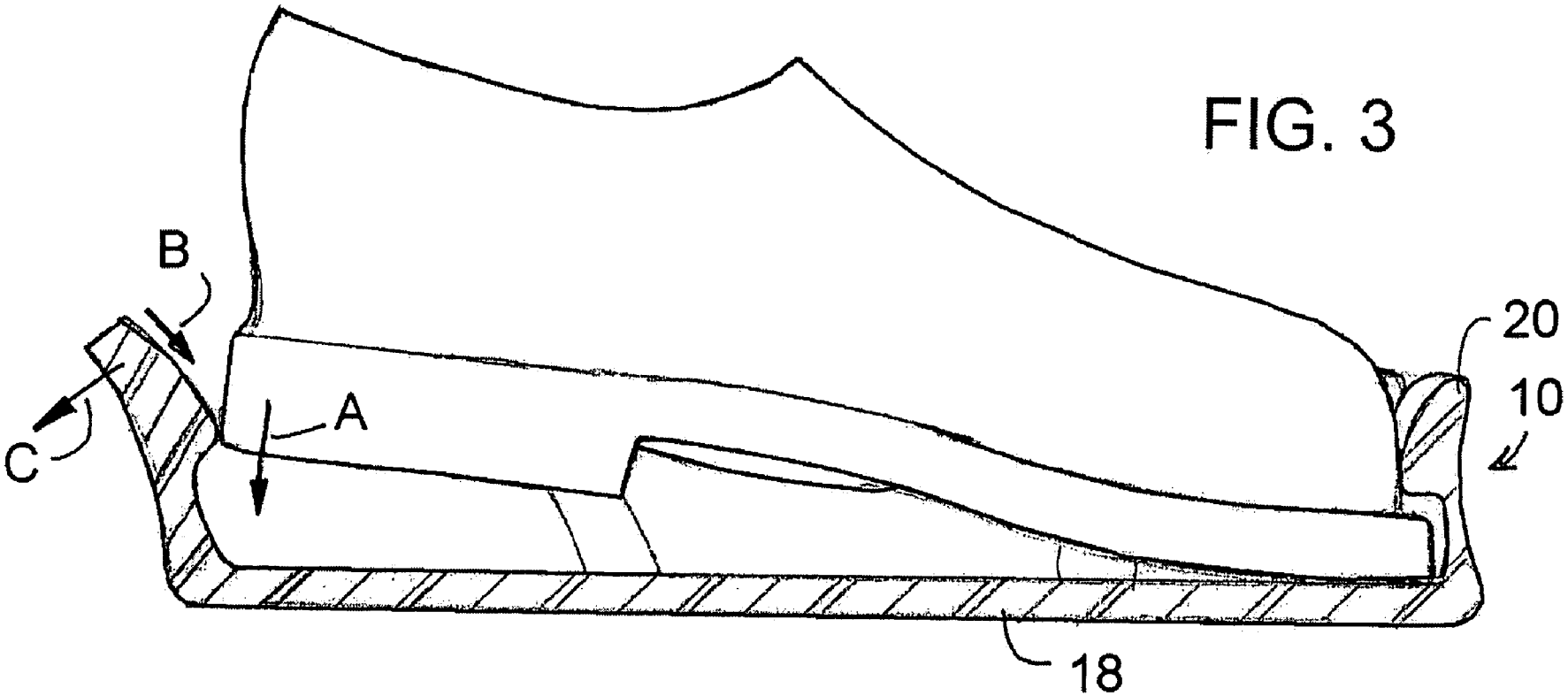
FIG. 3 is an explanatory side view of the shoe cover of the invention, in section, and with a shoe as it engaged the shoe cover in a toe-first method of donning the shoe cover without the use of the hands.

FIG. 3 illustrates an example with at least one admission portion in the heel portion of the shoe cover and how a shoe can be inserted toe-first into the toe portion and then pressed down at the heel of the shoe to slide along the lead-in surface to expand the admission portion, and then, due to the resilience and self-supporting nature of the admission portion, how the admission portion closes over the shoe (or at least its sole) to retain the shoe as illustrated in FIG. 5. The arrows in FIGS. 3 and 4 illustrate the directions of movement of the shoe at A, the sliding motion of the shoe sole at B and the resilient expansion direction of the admission finger at C. While these figures show only the shoe sole fitted into the undercut areas, the overhang surface and undercut area can be located elsewhere along the shoe's upper. The general pressure exerted by the admission portion against the shoe can contribute to the secure fit as well as the admission portion's shape.

In a method, not illustrated, the shoe can even be pushed straight down onto the self-supporting walls of the shoe cover, to expand the admission fingers on both the toe and heel portions, to expand them at the same time to admit the sole.

To better facilitate sliding of the shoe along the lead-in surface 20*a*, this surface is constructed to have a low coefficient of friction to facilitate sliding. Much of the shoe cover can be made of foam rubber, for example, with the lead-in surface of the admission portion treated, e.g. chemically or by the application of heat, to be smoother than other higher fiction surfaces of the cover. The lead-in surface may alternatively be covered by a harder, smooth plastic material to achieve the low friction effect. The surfaces in the undercut areas 20*c*, for example, may have a higher coefficient of friction than the lead-in surface 20*a*, to facilitate better hold of the shoe in the undercut area. The upper, shoe-contacting surface of the sole portion 18 may like-wise be of high friction material to better engage the shoe sole bottom with the shoe cover sole portion upper surface and make it easier to walk while wearing the shoe cover of the invention.

When more than one admission portion or finger is provided for either or both of the toe and heel portions, slots 22 are formed between the fingers so that the shoe admission portions better form articulating resilient shoe holding fingers.

Figure 2:
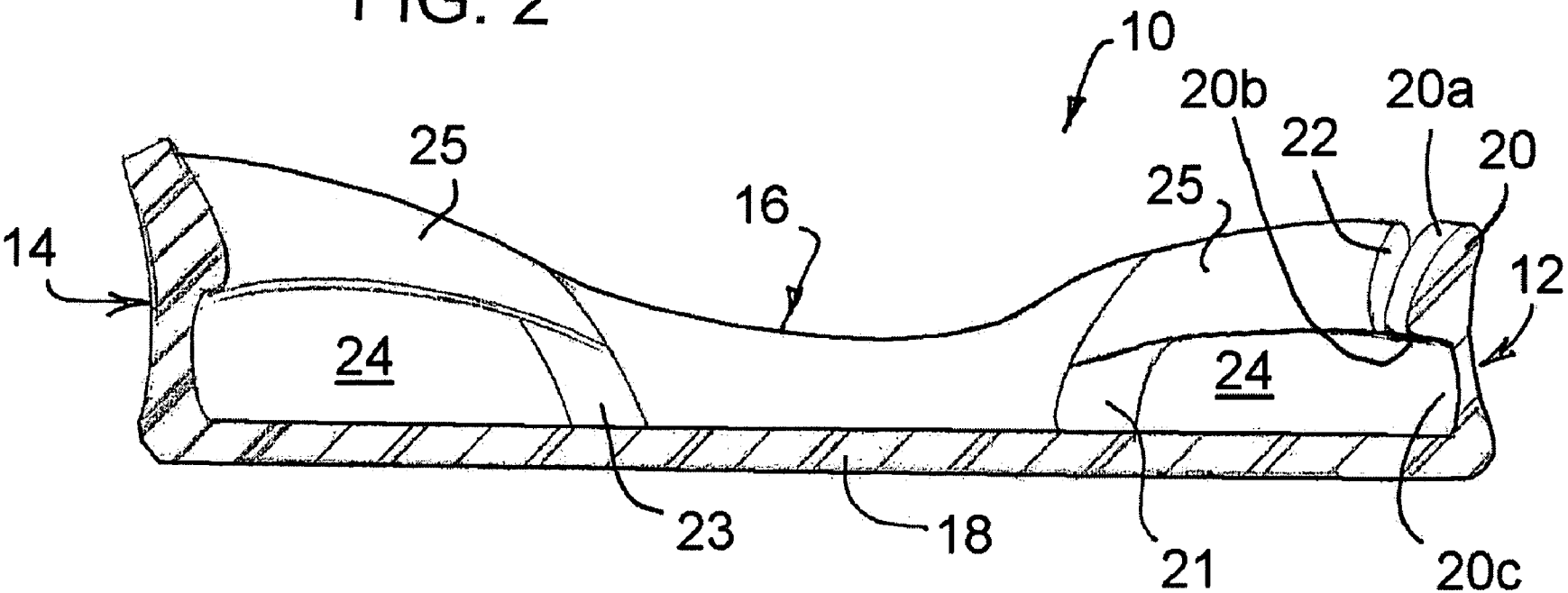
FIG. 2 is a longitudinal and central sectional view thereof.

As show in FIGS. 1 and 2, the spaces between articulating admission fingers 20 are covered by less rigid, more elastic sheet material 24, which may be water-proof. The intermediate portion 16 may also be formed of such sheet material that spans the space between the rear-most admission portion 21 of the toe portion and the forward-most admission portion 23 of the heel portion. Self-supporting extensions 25 also connect the tops of the admissions portions in the toe and heel portions, to better frame and sheets 24 and maintain the self-supporting nature of the walls at the toe and heel portions of the shoe cover. Such a framing extension may also be provided across the intermediate portion 16, between the toe and heel portion, but is not essential.

Figure 6:
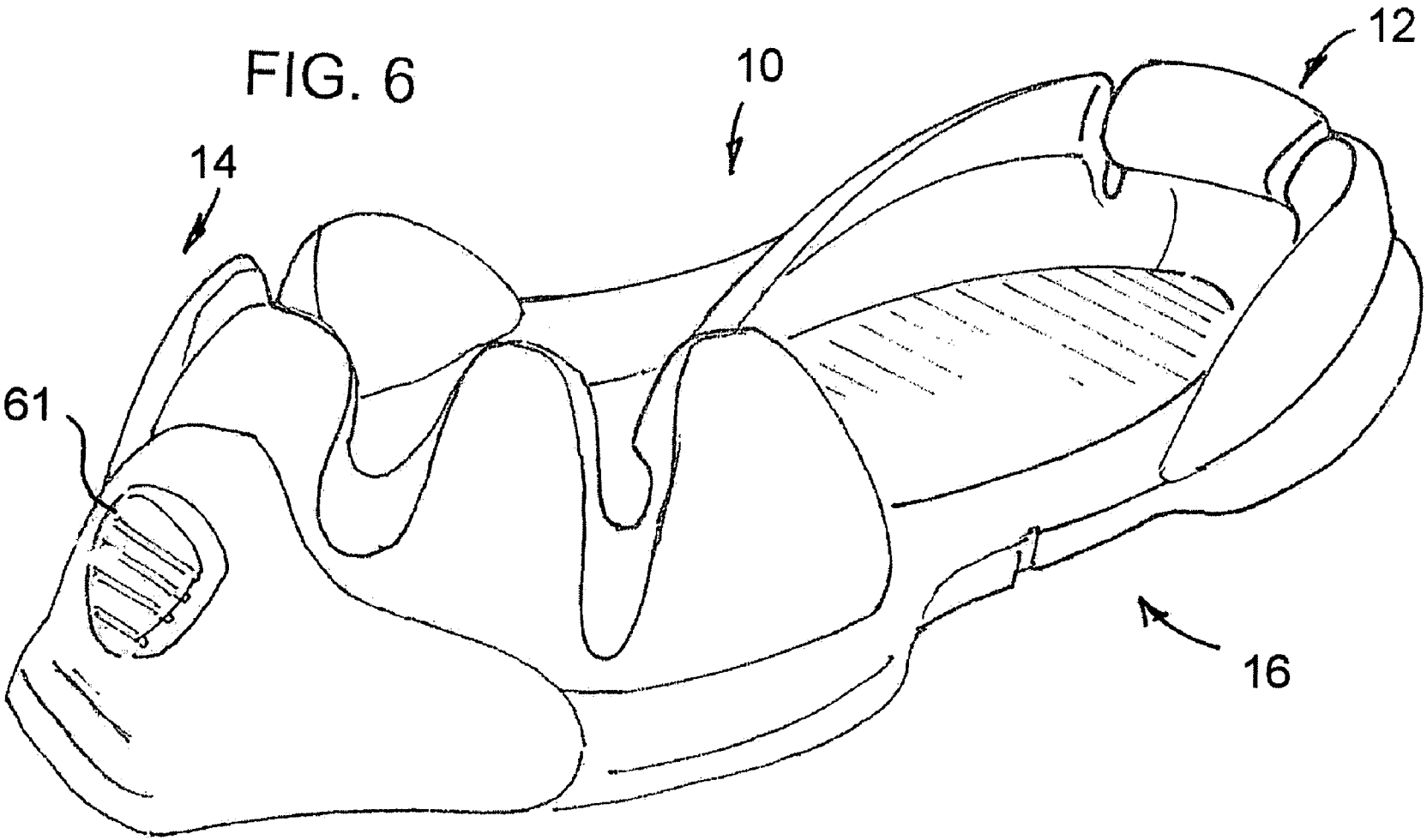
FIG. 6 is a perspective view of a second embodiment of the invention which includes a length adjusting mechanism for accommodating a wider range of shoe sizes.
Figure 7:
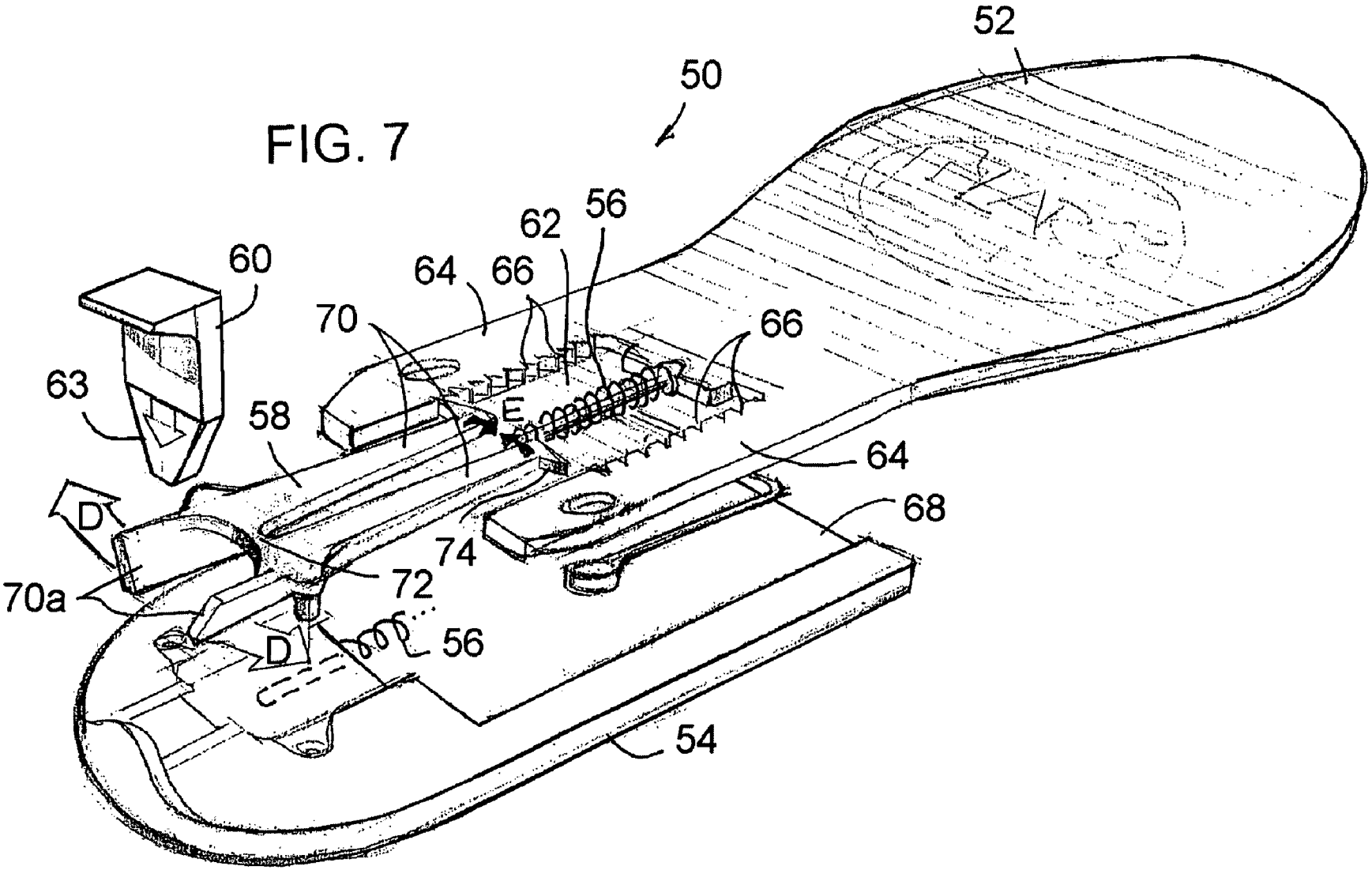
FIG. 7 is an exploded, perspective view of the length adjusting mechanism.
Figure 8:
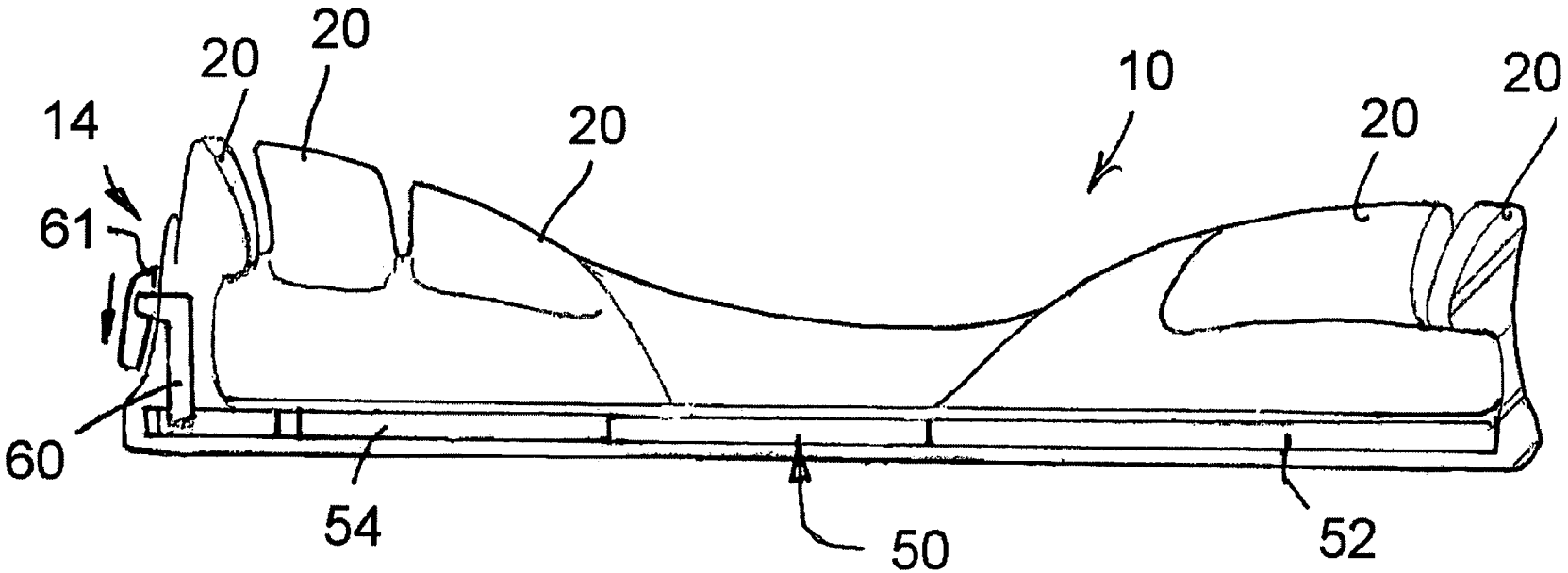
FIG. 8 is a schematic sectional view of the second embodiment showing the position of the length adjusting mechanism in the shoe cover

A further embodiment of the invention which may or may not include the specially shaped admission portions of the embodiment of FIGS. 1–5, is illustrated in FIGS. 6 to 8 and includes length adjusting means generally designated 50 connected between the toe portion 12 and the heel portion 14.

These adjusting means are disposed in the sole portion 18 and are provided for adjusting the overall length of the shoe cover 10 so that it can accommodate a larger number of shoe sizes. Thin, possibly water-proof, but elastic sheet material may cover the top and bottom surfaces of the length adjusting means 50.

As shown in FIG. 8, the articulating and resilient admission portions or fingers 20 may be present but are not essential. The self-supporting nature of the walls of the upper portions is important, however.

As best illustrated in FIG. 7, the length adjusting means 50 includes a flexible toe plate 52 extending in the sole portion and into the toe portion of the shoe cover, and a heel plate 54 slidable engaged to the toe plate and extending in the sole portion and into the heel portion. Biasing means such as a coil spring 56 or any other type of spring mechanism, is provided between the toe and heel plates 52, 54, for biasing the toe and heel plated apart. A lock or locking member 58 for locking the relative position between the toe 52 and heel 54 plates, sets a desired length of the shoe cover. An actuator 60 can be pushed down, for releasing the lock 58 and allowing the plates 52 and 54 to spread apart under the bias of spring 56.

Plate 52 includes a channel or recess 62 defined between a pair of projections 64. Facing surfaces of the projections 64 each carry a series of shaped notches 66 and the projections 64 slidably ride in a channel 68 on the heel plate 54 to maintain parallel alignment of the plates.

The locking member 58 comprises a pair of legs 70 that are pivotally connected to each other at a flexible connection bridge or pivot connection 72. Each has a projecting tooth 74 that engaged a notch 66 on one edge of the channel or recess 62. The teeth 74 and notches 66 are shaped so that when the heel portion around plate 54 is pushed toward the toe portion around plate 52, the locking member 50 clicks ever deeper into the recess 62 and the plate telescopically slide together. In each position, the teeth lock in place, however so that the heel portion cannot move away from the toe portion under the bias of spring 56. During this closing or shortening of the mechanism, the spring is compressed. This inward motion is continued until the shoe is firmly captured in the shoe cover.

To release the engagement and increase the length of the shoe cover, the actuator 60 is pushed down, e.g. using the toe of the other foot to depress an actuator cover 61 shown in FIG. 6, at the rear of the heel portion 14. This inserts a wedge 63 at the bottom of actuator or push button 60, between the rear leg extensions 70*a* of legs 70 that go back beyond the pivot connection 72, to spread the extension 70*a* apart in the direction arrows D. This moves the teeth 74 at the opposite ends of the legs 70 together in the direction of arrows E so that the teeth disengage from their notches 66 and the plated slide apart under the influence of spring 56. The heel area may also have a tab of projection as shown, that can be stepped on with the other foot to hold it down for removal of the shoe. Such a heel tab or projection may be provided on any embodiment of the invention.

Figure 9:
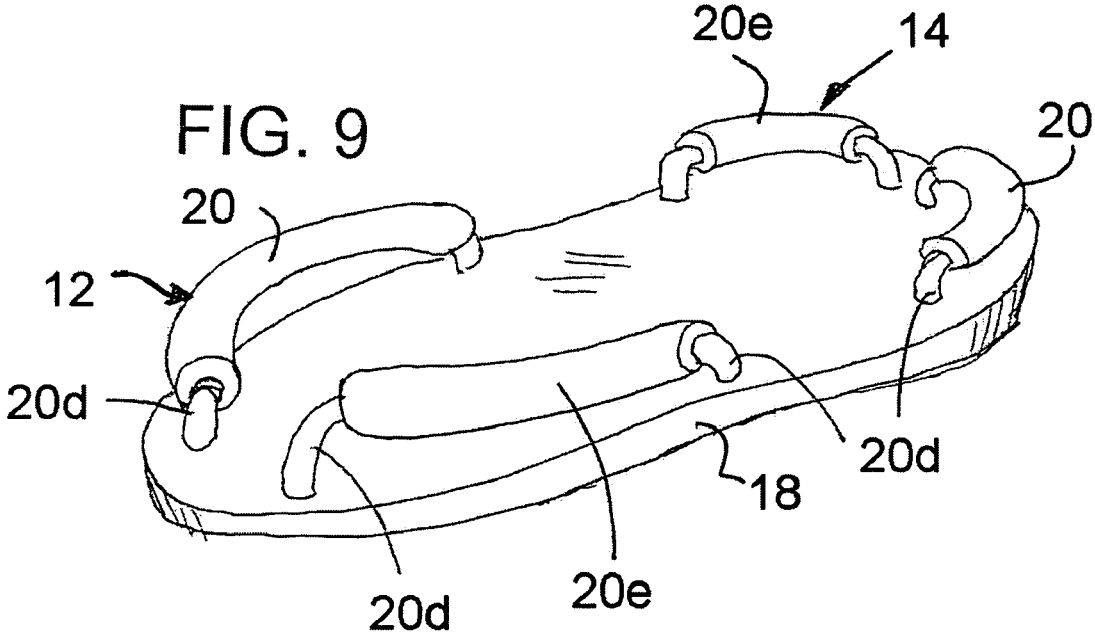
FIG. 9 is a perspective view of a third embodiment of the invention with differently formed admission portions at the toe and heel.
Figure 10:
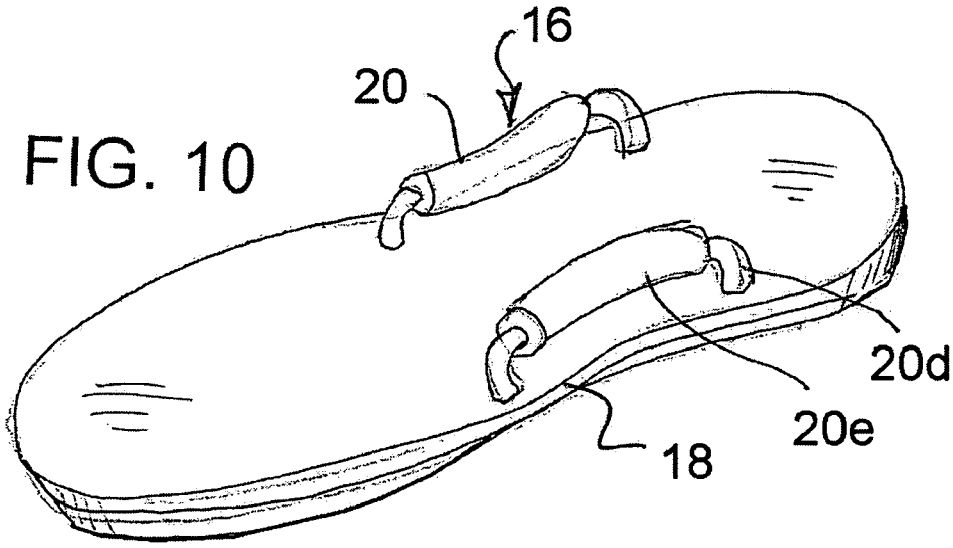
FIG. 10 is a perspective view of a fourth embodiment of the invention with alterative admission portions provided only at the intermediate portion of the shoe cover.

FIGS. 9 and 10 illustrate embodiments of the invention with minimal "walls" in the upper portion of the shoe cover. The toe and heel portions 12, 14, are each made up of two spaced apart admission portions 20. Each admission portion 20 may comprise a wire, plastic or other self-supporting frame 20*d* having opposite ends that are bent down to the sole portion 18, and are there fixed to the sole portion.

Figure 16:
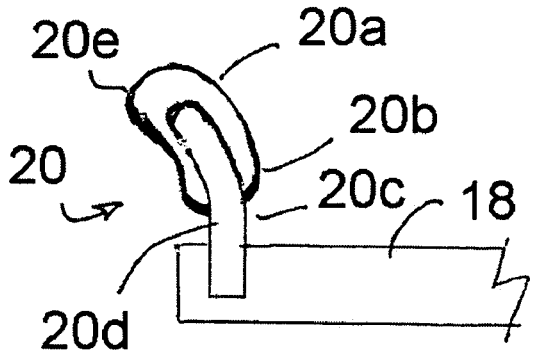

Each frame is central part that is curved to follow the general contour of a shoe toe or heel. A tubular, preferably resilient (e.g. foam, neoprene or rubber) member 20*e* extends across each frame and, as best shown in FIG. 16, defines the lead-in surface 20*a* and the overhang surface 20*b*, to form the undercut area 20*c*. In this embodiment of the invention, the overhang surface is spaced above the sole portion 18, rather than extending all the way to the sole portion as in the embodiment of FIG. 1, for example. The tubular member 20*e* may be kidney shapes in cross-section (FIG. 16) or substantially cylindrical (FIG. 9) or have some other tubular shape or even a non-tubular shape.

In the embodiment of FIG. 10, the admission portions 20 are only in the intermediate portion 16 of the upper since the inventor has found that by using the admission portions shaped and functioning according to the present invention, a shoe will be held to the shoe cover even with this minimal arrangement.

Figure 11:
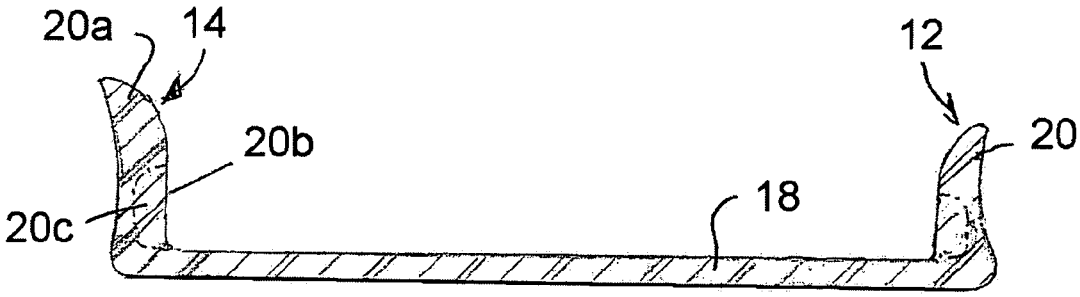
FIG. 11 is a simplified sectional view of a fifth embodiment of the invention showing the shape of its admission portions before a shoe in inserted.

FIG. 11 illustrates a still further embodiment of the invention where the admission portion or portions 20, whether at the toe, or heel, or intermediate portion, or some combination thereof, has an inclined lead-in surface 20*a* and a following overhang surface 20*b* which is adapted to form an undercut area 20*c* for receiving a shoe to be held to the cover. Without a shoe present, however, the overhang surface may simply extend straight down to the sole portion 18, without extending outwardly.

Figure 12:
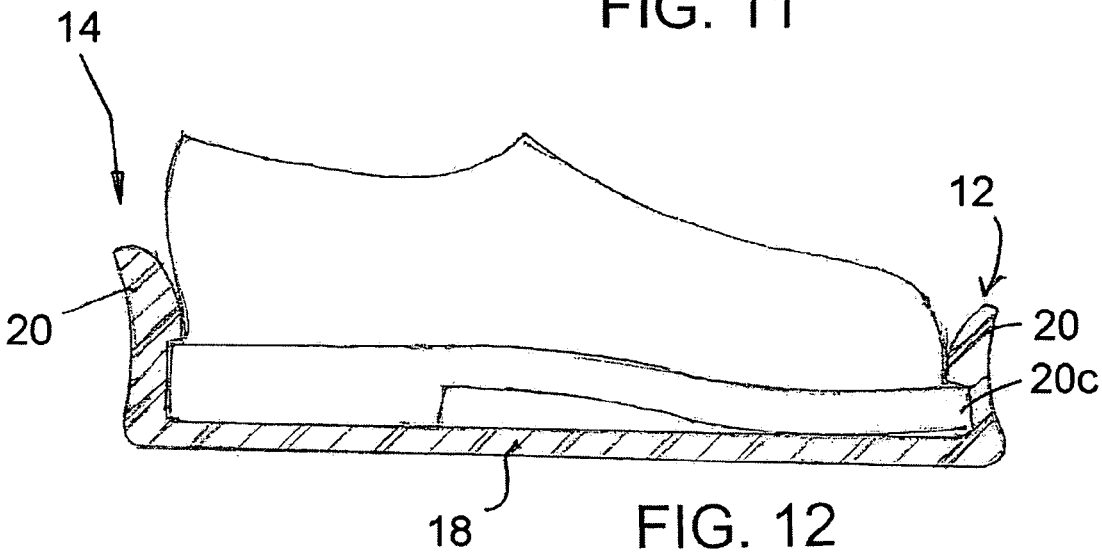
FIG. 12 is a view like FIG. 11 of the fifth embodiment showing the shape of its admission portions with a shoe inserted.

This capacity to form the undercut area or recess 20*c* is due to the compensability of the material of the admission portion 20, at least in the area of the undercut recess. If necessary, more rigid but still resilient plastic or other material may cover parts of the admission portion 20 to make sure that it is self-supporting, even when engaged by the shoe entering the cover and reaching its final position as illustrated in FIG. 12.

Figure 13:
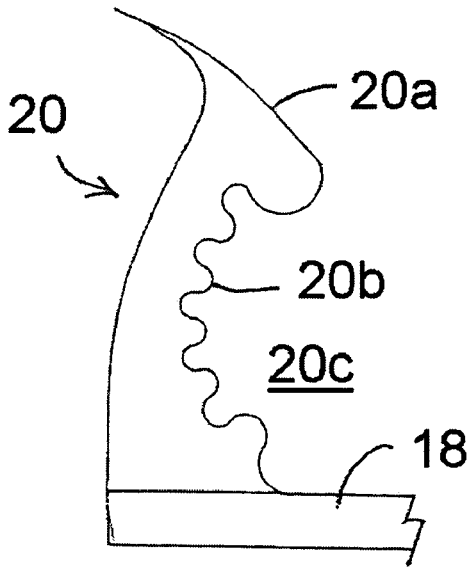
FIGS. 13 to 16 are partial side sectional views of other possible configurations for the admission portions of the invention.
Figure 14:
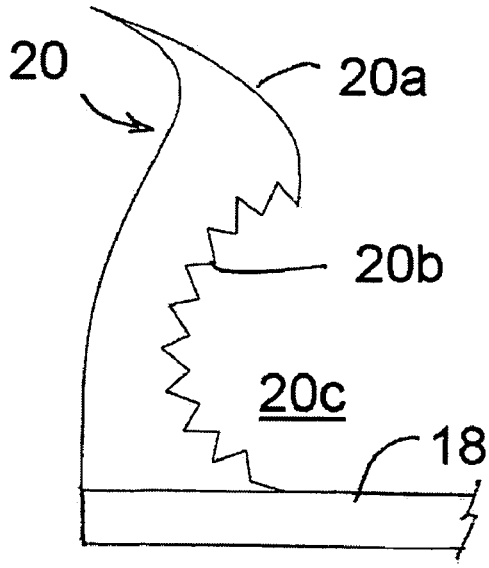

Referring now to FIGS. 13, 14, 15 and 16, different admission portion embodiments are illustrated. In the embodiment of FIGS. 1 through 12, 15 and 16, the lead-in and overhang surfaces 20*a* and 20*b*, are smooth curved surfaces that extend contiguously, one next to the other. In the embodiments of FIGS. 13 and 14, however, the overhang surfaces are corrugated. In FIG. 14 the overhang surface is corrugated with a plurality of angular teeth, and in FIG. 13 the overhang surface is corrugated with a plurality of rounded teeth. The respective transition between the lead-in and overhang surfaces are likewise sharp and rounded.

Figure 15:
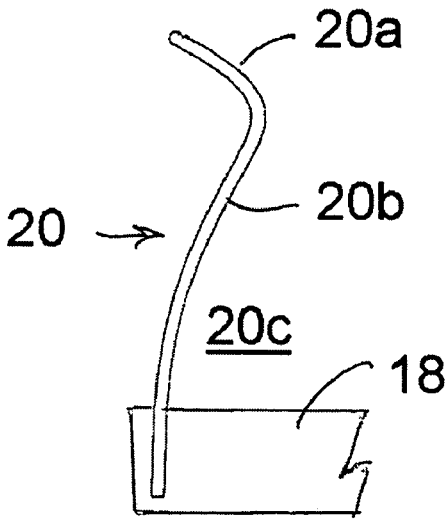

In FIG. 15 the admission portion is a curved sheet of self-supporting resilient material such as plastic or sheet metal, connected to the sole portion 18. In another embodiment (not shown) the sheet of FIG. 15 is applied, e.g. with adhesive, to the back (i.e. left hand side of FIGS. 13 and 14) and combined with the foam, rubber, neoprene or other soft material of the admission portion of FIGS. 13 and 14, to increase their self-supporting and resiliency characteristics.

Figure 17:
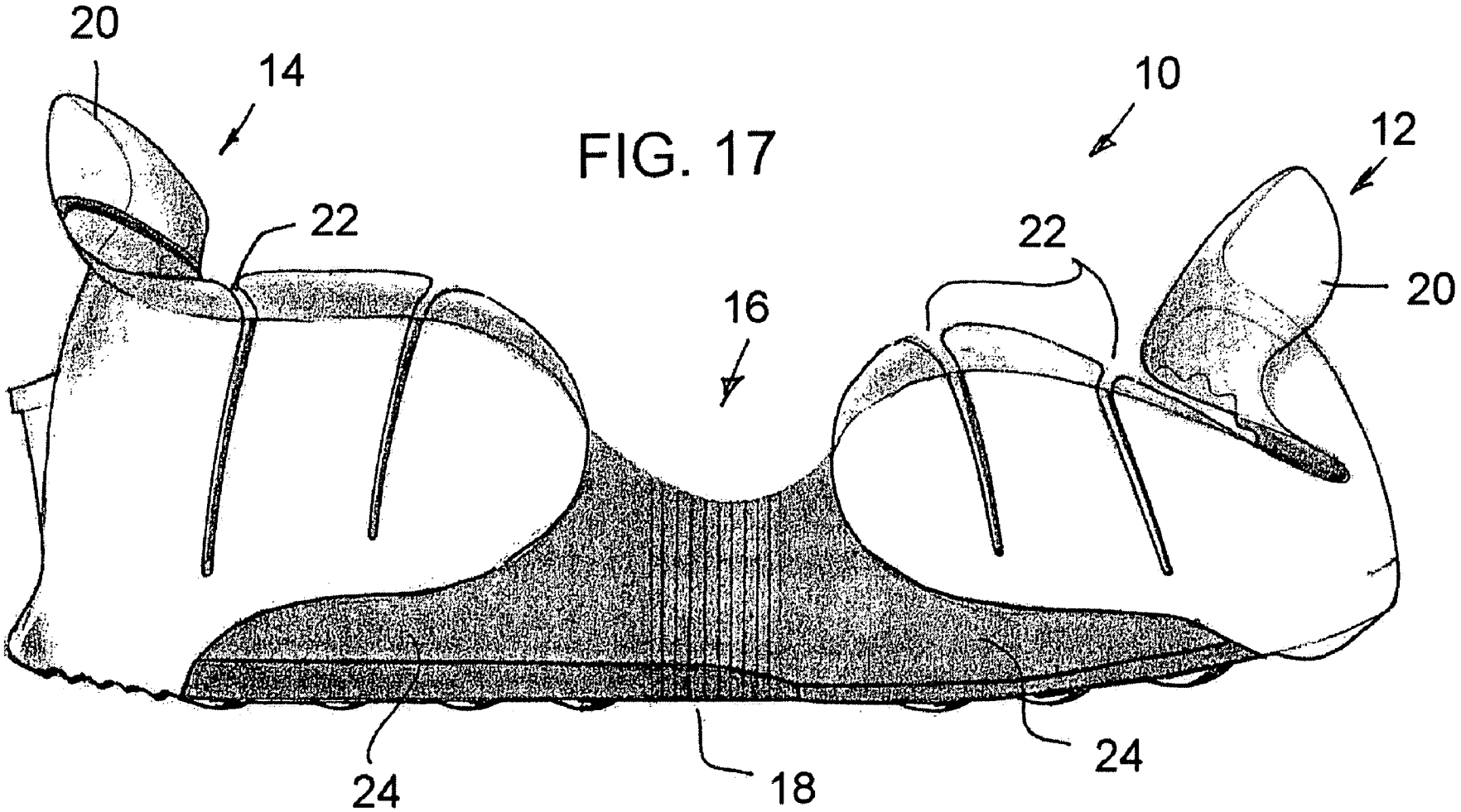
FIG. 17 is a side view of a further embodiment of the invention.

FIG. 17 illustrated another embodiment of the invention which includes multiple admission portions 20, structured as fingers that are connected together. Some of the fingers are connected to the sole 18 directly, and some are not but have elastic 24 beneath them.

While specific embodiments of the invention have been shown and described in detail to illustrate the application of the principles of the invention, it will be understood that the invention may be embodied otherwise without departing from such principles.

What is claimed is:

1. A shoe cover comprising:

an upper portion having at least one of a toe portion for receiving the toe of a shoe, a heel portion for receiving the heel of a shoe and an intermediate portion for receiving an intermediate part of a shoe; and a sole portion connected to the upper portion, the sole portion being flexible to allow walking when a shoe is held in the shoe cover;

the upper portion including at least one, self-supporting and resilient shoe admission portion connected to the sole portion, the shoe admission portion having an inwardly inclined lead-in surface extending toward the sole portion, and an overhang surface extending from the lead-in surface toward the sole portion, the overhang surface being adapted to form an undercut area so that a shoe to be held to the shoe cover first engages and slides along the inclined lead-in surface to resiliently expand the admission portion outwardly without being crushed, and then slides into engagement with the overhang surface to enter or form the undercut area as the shoe touches the sole portion while the shoe admission portion contracts resiliently inwardly to hold the shoe, the lead-in surface having a lower coefficient of friction than the overhang surface to facilitate sliding of the shoe into the undercut area.

2. A shoe cover according to claim 1, wherein the overhang surface is adapted to extend outwardly of the lead-in surface to form the undercut area, with and without a shoe engaged into the undercut area.

3. A shoe cover comprising:

an upper portion having at least one of a toe portion for receiving the toe of a shoe, a heel portion for receiving the heel of a shoe and an intermediate portion for receiving an intermediate part of a shoe; and a sole portion connected to the upper portion, the sole portion being flexible to allow walking when a shoe is held in the shoe cover;

the upper portion including at least one, self-supporting and resilient shoe admission portion connected to the sole portion, the shoe admission portion having an inwardly inclined lead-in surface extending toward the sole portion, and an overhang surface extending from the lead-in surface toward the sole portion, the overhang surface being adapted to form an undercut area so that a shoe to be held to the shoe cover first engages and slides along the inclined lead-in surface to resiliently expand the admission portion outwardly without being crushed, and then slides into engagement with the overhang surface to enter or form the undercut area as the shoe touches the sole portion while the shoe admission portion contracts resiliently inwardly to hold the shoe, and wherein the overhang surface is adapted to extend outwardly of the lead-in surface to form the undercut area only when a shoe engaged into the undercut area, the admission portion being compressible in the undercut area to compress in the presence of the shoe to form the undercut area.

4. A shoe cover according to claim 1, wherein the toe and heel portions each include at least one said admission portion.

5. A shoe cover according to claim 1, wherein the toe portion includes at least one said admission portion.

6. A shoe cover according to claim 1, wherein the heel portion includes at least one said admission portion.

7. A shoe cover according to claim 1, wherein the intermediate portion includes at least one said admission portion.

8. A shoe cover according to claim 1, including at least two said admission portions with at least one being connected directly to the sole portion, the upper portion having a slot between said at least two admission portions so that said admission portions form resilient fingers for holding a shoe to the shoe cover.

9. A shoe cover according to claim 1, wherein the lead-in and overhang surfaces are smooth curved surfaces that extend contiguously one next to the other.

10. A shoe cover comprising:

an upper portion having at least one of a toe portion for receiving the toe of a shoe, a heel portion for receiving the heel of a shoe and an intermediate portion for receiving an intermediate part of a shoe; and a sole portion connected to the upper portion, the sole portion being flexible to allow walking when a shoe is held in the shoe cover;

the upper portion including at least one, self-supporting and resilient shoe admission portion connected to the sole portion, the shoe admission portion having an inwardly inclined lead-in surface extending toward the sole portion, and an overhang surface extending from the lead-in surface toward the sole portion, the overhang surface being adapted to form an undercut area so that a shoe to be held to the shoe cover first engages and slides along the inclined lead-in surface to resiliently expand the admission portion outwardly without being crushed, and then slides into engagement with the overhang surface to enter or form the undercut area as the shoe touches the sole portion while the shoe admission portion contracts resiliently inwardly to hold the shoe, and wherein the overhang surface is corrugated.

11. A shoe cover according to claim 10, wherein the overhang surface is corrugated with a plurality of angular teeth.

12. A shoe cover according to claim 10, wherein the overhang surface is corrugated with a plurality of rounded teeth.

13. A shoe cover according to claim 1, wherein the admission portion is a curved sheet of self-supporting resilient material connected to the sole portion.

14. A shoe cover comprising:

an upper portion having at least one of a toe portion for receiving the toe of a shoe, a heel portion for receiving the heel of a shoe and an intermediate portion for receiving an intermediate part of a shoe; and a sole portion connected to the upper portion, the sole portion being flexible to allow walking when a shoe is held in the shoe cover;

the upper portion including at least one, self-supporting and resilient shoe admission portion connected to the sole portion, the shoe admission portion having an inwardly inclined lead-in surface extending toward the sole portion, and an overhang surface extending from the lead-in surface toward the sole portion, the overhang surface being adapted to form an undercut area so that a shoe to be held to the shoe cover first engages and slides along the inclined lead-in surface to resiliently expand the admission portion outwardly without being crushed, and then slides into engagement with the overhang surface to enter or form the undercut area as the shoe touches the sole portion while the shoe admission portion contracts resiliently inwardly to hold the shoe, and wherein the admission portion comprises a tubular member and means for connected the tubular member over the sole portion.

15. A shoe cover according to claim 1, including length adjusting means connected to, or being within, the sole portion for adjusting the length of the shoe cover.

16. A shoe cover according to claim 15, wherein the length adjusting means includes a flexible toe plate extending toward the front of the sole portion, a heel plate slidable engaged to the toe plate and extending toward the rear of the sole heel portion, biasing means between the toe and heel plates for biasing the toe and heel plated apart, a lock for locking the relative position between the toe and heel plates for setting a length of the shoe cover and an actuator for releasing the lock.

17. A shoe cover comprising:

an upper portion for receiving at least one of a toe, a heel and an intermediate part of a shoe;

a sole portion connected to the upper portion, the sole portion being flexible to allow walking when a shoe is held to the shoe cover;

length adjusting means connected to the sole portion for adjusting the length of the shoe cover, the length adjusting means including biasing means for adjusting the length of the sole portion, lock means for holding the sole portion at a plurality of lengths, and release means for releasing the lock means to allow the sole portion to adjust in length under the bias of the biasing means; and the length adjusting means including a flexible toe plate extending toward the front of the sole portion, a heel plate slidable engaged to the toe plate and extending toward the rear of the sole heel portion, biasing means between the toe and heel plates for biasing the toe and heel plated apart, a lock for locking the relative position between the toe and heel plates for setting a length of the shoe cover and an actuator for releasing the lock.

18. A shoe cover according to claim 17, wherein the upper portion included at least one, self-supporting and resilient shoe admission portion connected to the sole portion, the shoe admission portion having an inwardly inclined lead-in surface extending toward the sole portion, and an overhang surface extending from the lead-in surface toward the sole portion, the overhang surface being adapted to form an undercut area so that a shoe to be held to the shoe cover first engages and slides along the inclined lead-in surface to resiliently expand the admission portion outwardly without being crushed, and then slides into engagement with the overhang surface to enter or form the undercut area as the shoe touches the sole portion while the shoe admission portion contracts resiliently inwardly to hold the shoe.

19. A shoe cover according to claim 18, wherein the lead-in surface has a lower coefficient of friction than the overhang surface to facilitate sliding of the shoe into the undercut area.

20. A shoe cover according to claim 18, wherein the overhang surface is adapted to extend outwardly of the lead-in surface to form the undercut area, with and without a shoe engaged into the undercut area.

21. A shoe cover according to claim 18, wherein the overhang surface is adapted to extend outwardly of the lead-in surface to form the undercut area only with a shoe engaged into the undercut area, the admission portion being compressible in the undercut area to compress in the presence of the shoe to form the undercut area.

22. A shoe cover according to claim 18, including at least two said admission portions.

23. A shoe cover according to claim 18, including at least two said admission portions with at least one being connected directly to the sole portion, the upper portion having a slot between said at least two admission portions so that said admission portions form resilient fingers for holding a shoe to the shoe cover.

24. A shoe cover according to claim 18, wherein the lead-in and overhang surfaces are smooth curved surfaces that extend contiguously one next to the other.

25. A shoe cover according to claim 18, wherein the overhang surface is corrugated.

26. A shoe cover according to claim 18, wherein the overhang surface is corrugated with a plurality of angular teeth.

27. A shoe cover according to claim 18, wherein the overhang surface is corrugated with a plurality of rounded teeth.

28. A shoe cover according to claim 18, wherein the admission portion is a curved sheet of self-supporting resilient material connected to the sole portion.

29. A shoe cover according to claim 18, wherein the admission portion comprises a tubular member and means for connected the tubular member over the sole portion.

* * * * *